US008585446B2

(12) United States Patent
Manske et al.

(10) Patent No.: US 8,585,446 B2
(45) Date of Patent: Nov. 19, 2013

(54) CONNECTOR HOUSING INCLUDING CAVITY HAVING DRAFT ANGLE WITH RIB HAVING SAME

(75) Inventors: Petra Manske, Wuppertal (DE); Andreas Sikora, Hagen (DE); Klaus Mahr, Wuppertal (DE)

(73) Assignee: Delphi Technologies, Inc., Troy, MI (US)

( * ) Notice: Subject to any disclaimer, the term of this patent is extended or adjusted under 35 U.S.C. 154(b) by 155 days.

(21) Appl. No.: 13/255,265

(22) PCT Filed: Feb. 19, 2010

(86) PCT No.: PCT/EP2010/001065

§ 371 (c)(1), (2), (4) Date: Nov. 15, 2011

(87) PCT Pub. No.: WO2010/102715

PCT Pub. Date: Sep. 16, 2010

(65) Prior Publication Data

US 2012/0064778 A1 Mar. 15, 2012

(30) Foreign Application Priority Data

Mar. 11, 2009 (EP) ..... 09003536

(51) Int. Cl.
*H01R 13/514* (2006.01)

(52) U.S. Cl.
USPC ..... 439/752; 439/595; 439/752.5

(58) Field of Classification Search
USPC ..... 439/595, 660, 752, 752.5
See application file for complete search history.

(56) References Cited

U.S. PATENT DOCUMENTS

| | | | | |
|---|---|---|---|---|
| 4,298,566 | A | 11/1981 | Naus et al. | |
| 5,671,088 | A * | 9/1997 | Mai et al. | 359/424 |
| 5,893,780 | A | 4/1999 | Durand-Cochet | |
| 5,906,499 | A * | 5/1999 | Sikora et al. | 439/271 |
| 6,234,848 | B1 * | 5/2001 | Sikora et al. | 439/752 |
| 2003/0190842 | A1 | 10/2003 | Fukatsu et al. | |
| 2012/0064778 | A1 * | 3/2012 | Manske et al. | 439/660 |

* cited by examiner

*Primary Examiner* — James Harvey
(74) *Attorney, Agent, or Firm* — Robert J. Myers

(57) ABSTRACT

A connector housing includes at least one contact part chamber. At least one inside surface of the chamber contains a draft angle. The inside surface also contains at least one rib which has no inclination or a lesser inclination than that of the draft angle and extends in a longitudinal direction similar to that of the draft angle.

12 Claims, 4 Drawing Sheets

CONNECTOR HOUSING INCLUDING CAVITY HAVING DRAFT ANGLE WITH RIB HAVING SAME

CROSS-REFERENCE TO RELATED APPLICATION

This application claims the benefit under 35 U.S.C. §371 of published PCT Patent Publication No. PCT/EP2010/102715, filed on 19 Feb. 2010, which claims priority to EP 09003536.1 filed on 11 Mar. 2009, the entire disclosure of which is hereby respectively incorporated by reference herein.

TECHNICAL FIELD

The present invention relates generally to housings of electrical connectors.

BACKGROUND OF INVENTION

It is known to use connectors in electrical applications that may join electrical components together.

As a result of the draft conicity as well as additional manufacturing tolerances, traditional connectors may have considerable, undesired clearance between the inner surfaces of the contact part chamber and the contact part which is received by it, which may lead to interruptions of contact—so-called microinterruptions—caused by vibrations, in particular when the connector is subject to high acceleration (greater than 30 G), as is frequently the case with vehicle applications. Additionally, it is also desired to construct a connector housing having ease of manufacturing.

It is therefore the object of the invention to further develop a generic connector housing in such a way that the risk of microinterruptions occurring is at least reduced and where the connector housing is more easily manufactured.

SUMMARY OF THE INVENTION

The present invention concerns a housing for an electrical connector having at least one contact part chamber for receiving a contact part, wherein at least one inner surface of the contact part chamber is designed with a draft angle. Furthermore, the invention concerns a connector with such a housing, in the contact part chamber of which is arranged a contact part which in technical jargon can be designed as a female or male terminal.

The design of the inner surfaces of the contact part chamber with a draft angle is necessary here for manufacturing reasons, in order to be able to easily separate a housing made by injection molding from the injection mold, in particular from the injection core which forms the contact part chamber, after the injection molding process.

In particular, the object of the invention is achieved by the fact that at least one rib which has no or only a lesser inclination than the draft angle extends in the longitudinal direction of the at least one draft angle, i.e. in the direction of the maximum inclination of the draft angle. In other words, the at least one rib therefore projects above the at least one draft angle. Due to the ribs, the gap between the draft angle and a contact part which can be received by the contact part chamber is thus at least partially bridged, so that a contact part which is received by the contact part chamber is secured substantially without play in the contact part chamber.

Due to the ribs in question, the clearance between the draft angles and a contact part which can be received by the contact part chamber can thus be reduced or even eliminated, as a result of which unwanted microinterruptions can be effectively counteracted. Since the ribs according to the invention are designed without draft angles or only with draft angles which have a lesser inclination than the inner surfaces of the contact part chamber which are designed with draft angles, when the housing is removed from the injection core, slightly higher frictional forces arise between the housing and the injection core. However, these slightly elevated frictional forces are confined exclusively to the ribs which are only provided separately, so that in general good ejection behavior can be ensured in spite of the ribs.

Thus, according to a preferred embodiment, it is provided that the contact part chamber of the housing is laterally defined by several draft angles, wherein on the upper surface of each of the draft angles is provided at least one rib extending in the longitudinal direction. This embodiment, in which several surfaces defining the inner circumference of the contact part chamber on the outside are provided with ribs in the manner according to the invention, enables an effective reduction or damping of microinterruptions as a result of vibrations in different directions. Thus a fit which is without play in different directions is ensured for the contact part to be received by the contact part chamber, so that the housing according to the invention can be used in any situations and orientations of installation.

According to the invention, for the first time a housing is provided for an electrical connector of which the contact part chamber widens in the direction of an ejection opening for introducing an injection core into the contact part chamber and taking it out, wherein the height of the ribs which are provided on the draft angles formed in this way increases in the direction of the ejection opening, this being preferably by substantially the same amount by which the respective draft angle widens the contact part chamber in the direction of the ejection opening. This embodiment proves to be advantageous in particular when the contact part to be received by the contact part chamber, seen in the direction of insertion, has substantially constant outside dimensions. In this case, due to the ribs which are provided on the draft angles and of which the height increases by approximately the same amount in the direction of the ejection opening as the associated draft angle widens in the direction of the ejection opening, the contact part seen in the direction of insertion can be kept free from play over a greater extent.

It is particularly advantageous if both the respective draft angles and the ribs provided on them, in each case, widen in the direction of the ejection opening with an angle of the order of magnitude between 0.25° and 0.75°, preferably approximately 0.5°. In other words, the height of the respective rib increases within the range of the angles indicated precisely by the amount by which the respective draft angle widens in the direction of the ejection opening, with the result that, in the manner described above, a fit which is particularly good because it is free from play is provided for a contact part to be received by the contact part chamber.

Because the damping ribs may have a certain excess size in relation to a contact part to be received by the contact part chamber, according to a further embodiment it can prove advantageous if the ribs seen in cross-section have a slender shape which is rectangular or tapers towards their free end. As a result it may be ensured that the ribs may easily be deformed when a contact part is introduced into the contact part chamber, as a result of which the assembly of a connector may be made easier, using a housing according to the invention.

Further, assembly may be made easier according to a further embodiment by the fact that the ribs may have a ramp section which widens in the direction of the ejection opening at their end facing towards the ejection opening. By this means the introduction of a contact part into the contact part chamber is made easier due to the funnel effect.

According to a further aspect of the present invention, the object on which it is based is also achieved with a connector which in addition to the housing described above has a contact part arranged in its contact part chamber, wherein according to a preferred embodiment it is provided that the ribs have such a height that they are slightly deformed when the contact part is introduced into the contact part chamber. As a result, a fit which is particularly free from play because it is tight is provided for the contact part within the contact part chamber so that the development of unwanted microinterruptions may be counteracted effectively.

To guarantee a fit of the contact part within the contact part chamber which is as tight as possible, according to a further embodiment, the contact part can have a peripheral surrounding spring, wherein the inside width between mutually opposed ribs in the slack, undeformed state is smaller than the outside dimension of the surrounding spring of the contact part located in between. The surrounding spring of the contact part thus equalizes the compression forces caused by the ribs on the contact part as a result of their deformation, without the individual contact blades of the contact part being deformed.

BRIEF DESCRIPTION OF THE DRAWINGS

Below, the invention will now be described purely by way of example with reference to the attached drawings, in which.

DETAILED DESCRIPTION

For a better understanding of the invention, first a traditional connector or traditional connector housing will be described with reference to FIGS. 1 and 2, in which no damping ribs are provided on the inner surfaces of the contact part chamber.

Figures 1, 2:
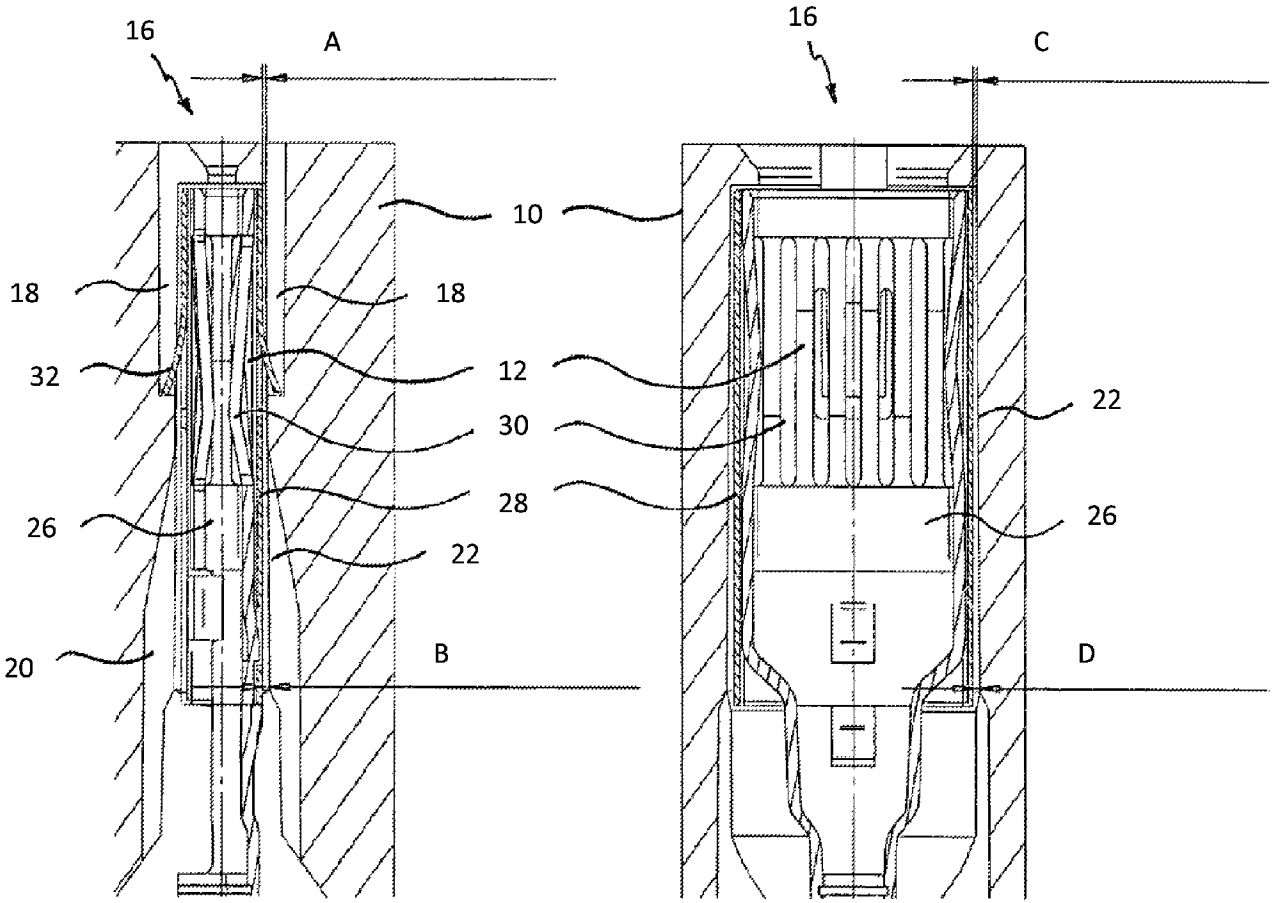
FIG. 1 shows a longitudinal section of a traditional connector housing without damping ribs in a vertical view.
FIG. 2 shows a longitudinal section of the connector housing of FIG. 1 in a top view.

As can be seen from the drawings of FIGS. 1 and 2, the connector housing 10, which is shown in section here, has an elongate shape, and through it extends a contact part chamber 12 which extends between an ejection opening 14 and a contacting opening 16. The ejection opening 14 here serves to introduce an injection core into the contact part chamber 12 and take it out during manufacture of the connector housing 10 by injection molding, whereas the contacting opening 16 serves to bring a countercontact part into contact with the contact part 26 received by the contact part chamber 12, for electrical contacting. As can be seen by looking at FIGS. 1 and 2 together, the contact part 26, which has also been introduced into the contact part chamber 12 through the ejection opening 14, has a sleeve-like peripheral surrounding spring 28 which accommodates in its interior the contact blades or tongues 30 of the contact part 26. Although the contact part 26 is surrounded by the spring 30 in the embodiment shown, it should be mentioned at this point that the contact part 26 can also be received directly by the contact part chamber 12, without a surrounding spring 30 being provided. As FIG. 1 shows, the sleeve-like surrounding spring 28 has, on two mutually opposed sides, spring latch tongues 32 which engage resiliently in spring latch recesses 18 formed in the housing 10, to keep the contact part 26 in captive relationship in the contact part chamber 12. Furthermore, the housing 10 has two regions 20 which widen in the direction of the ejection opening 14 and which make it easier to introduce the contact part 26 into the contact part chamber 12.

As may be seen from the vertical view of FIG. 1, the surrounding spring 28 of the contact part 26 has a certain clearance from the inner surface 22 of the contact part chamber 12, which increases in the direction of the ejection opening 14 from initially approximately 0.25 mm to approximately 0.45 mm. In a corresponding manner, the surrounding spring 28 in the view shown in FIG. 2 also has a clearance from the lateral inner surfaces 22, which increases in the direction of the ejection opening 14 from initially approximately 0.35 mm to approximately 0.55 mm. This increase in the clearance is wanted in order to be able to easily separate the connector housing 10 from an injection core which has been introduced into the contact part chamber 12 during removal from the mold after the injection molding process has taken place.

Figure 3:
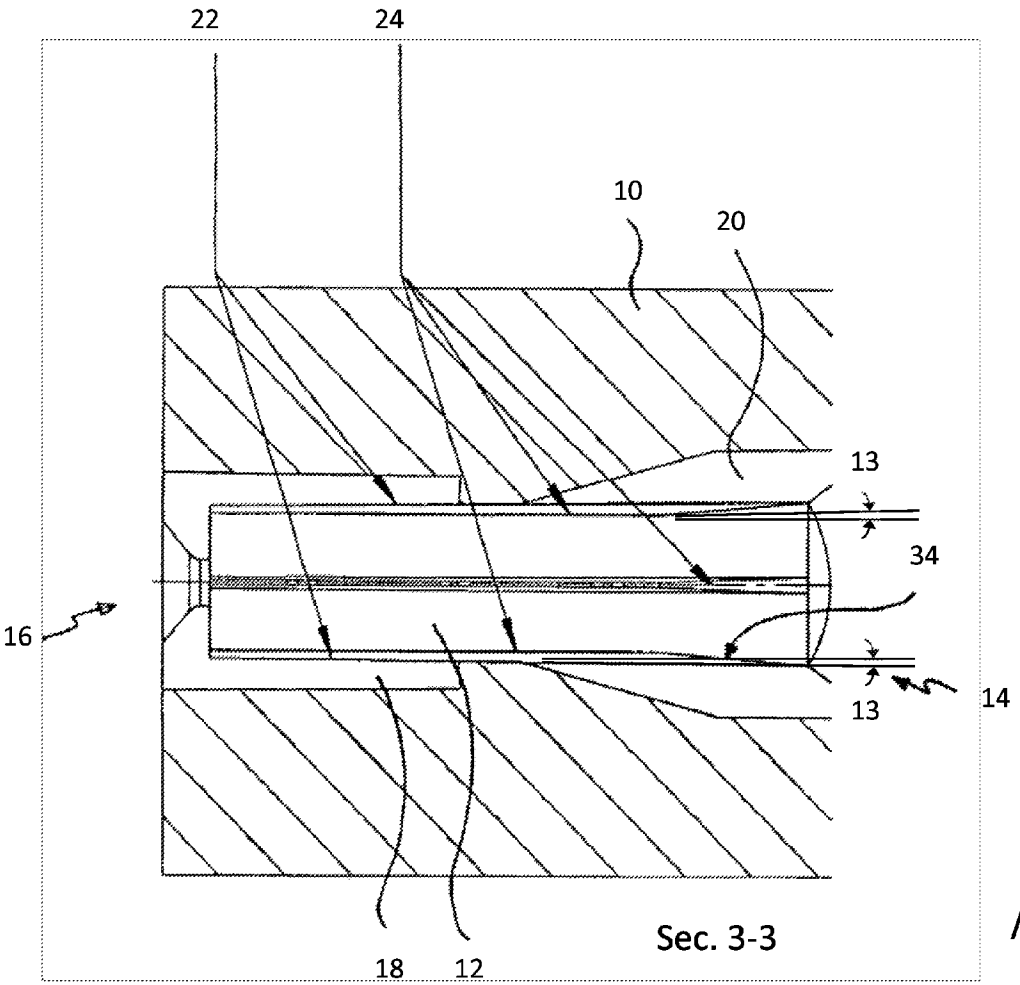
FIG. 3 shows a longitudinal section through a connector housing according to the invention in a vertical view.
Figure 4:
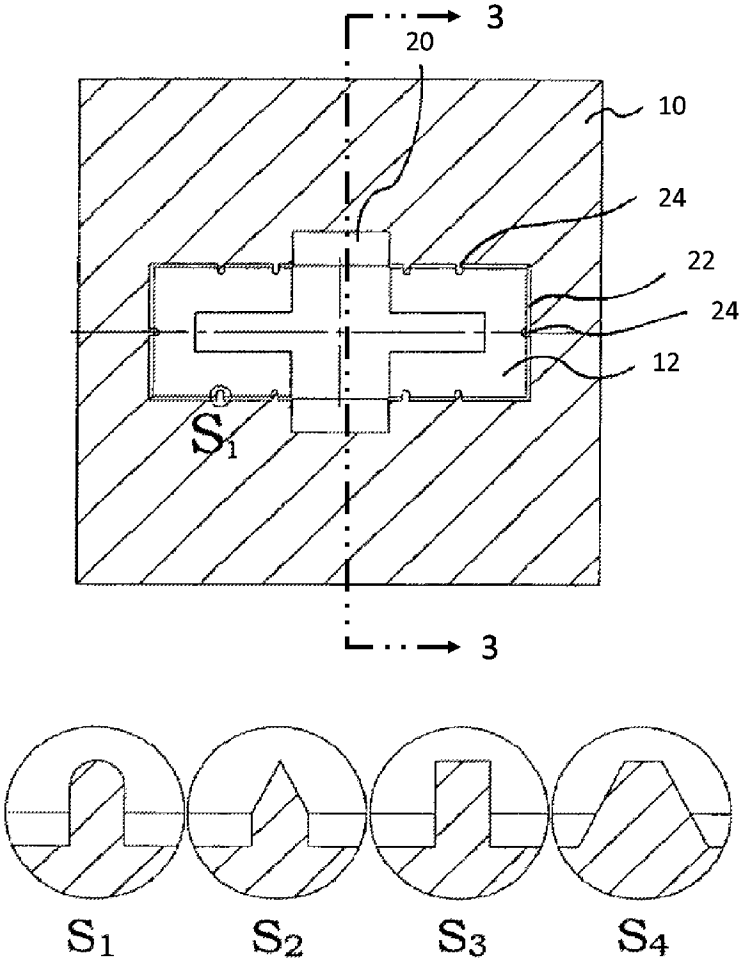
FIG. 4 shows a cross-sectional view of the connector housing shown in FIG. 3.
Figure 5:
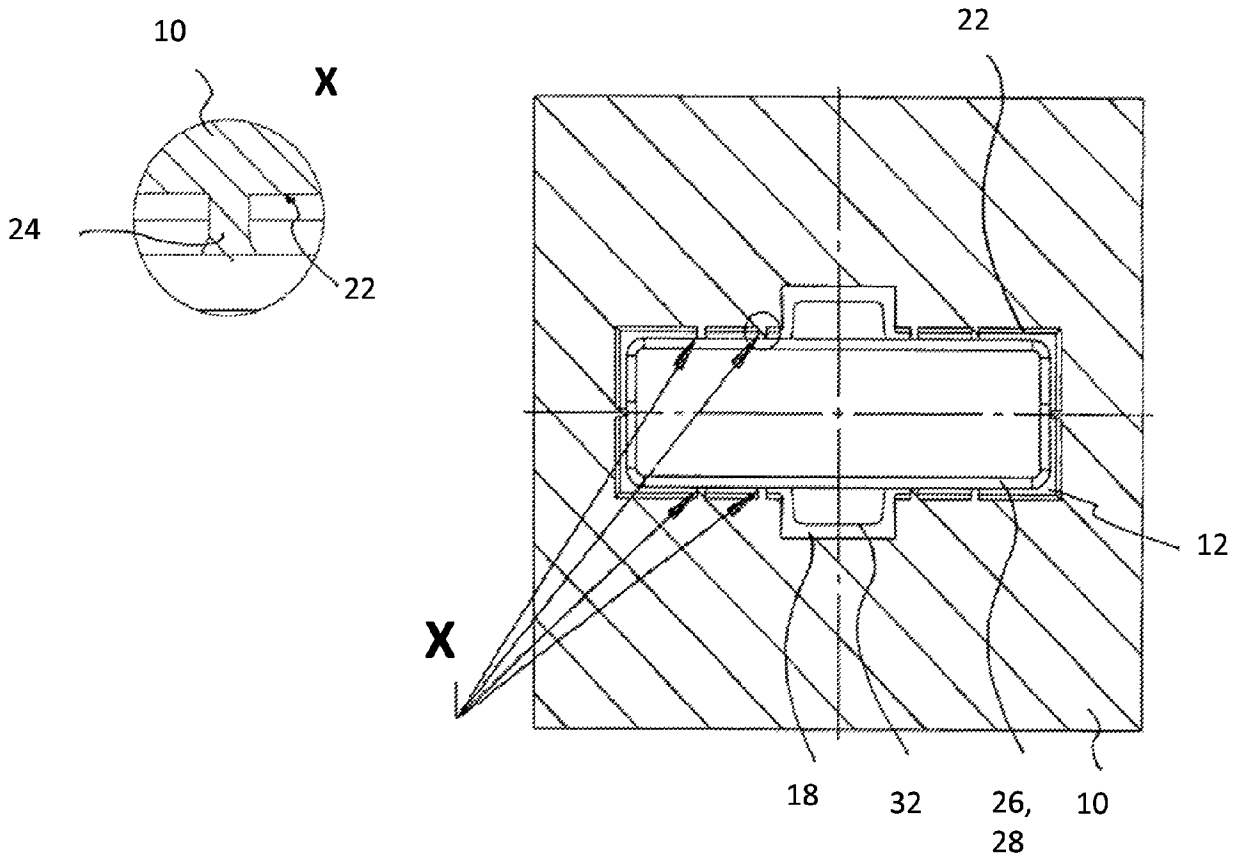
FIG. 5 shows a cross-sectional view through a connector according to the invention.

Since however the occurrence of microinterruptions is favored by the clearance between the surrounding spring 28 of the contact part 26 and the inner surface 22 of the contact part chamber 12, according to the invention it is proposed to provide along the upper surface of the inner surfaces 22 of the contact part chamber 12, which are designed with a draft angle 13 in the manner described above, ribs 24 extending in the longitudinal direction, that is, in the direction of the maximum inclination of the draft angles, as described in more detail below with reference to FIGS. 3 to 5. Apart from the additional provision of the damping ribs 24 according to the invention, the housing 10 shown in FIGS. 3 to 5 and the contact part 26 received by it correspond to the components with reference to FIGS. 1 and 2, so that in this respect reference can be made to FIGS. 1 and 2 as well as the associated description.

As FIG. 3 shows, the mutually opposed inner surfaces 22 or the upper surfaces 22 of the contact part chamber 12 of the connector housing 10 according to the invention which face into the interior of the contact part chamber 12 are designed with a draft angle 13 which widens in the direction of the ejection opening 14 with an angle of inclination of approximately 0.5°, which causes the increases in clearance described above with reference to FIGS. 1 and 2. To reduce the occurrence of microinterruptions which can arise due to the clearance described between the contact part 26 and the inner surfaces 22 of the contact part chamber 12, at least the inner or upper surfaces 22 of the contact part chamber 12 which are designed with a draft angle 13 are provided with ribs 24 which extend in the longitudinal direction of the respective draft angle 13 and which have no or only a lesser inclination than the respective draft angle 13 and so project above the inner surfaces 22. The ribs 24 in question therefore extend, starting from the upper surface of the inner surfaces 22, into the interior of the contact part chamber 12. The respective ribs 24 in this case essentially have a height such as to equalize the clearance described above with reference to FIGS. 1 and 2 between the surrounding spring 28 of the contact part 26 and the inner surfaces 22 of the contact part chamber 12, which means that the height of the respective rib 24 increases from an initial height of the order of magnitude of approximately 0.25 or approximately 0.35 mm in the direction of the ejection opening 14, to a height of approximately 0.45 mm or approximately 0.55 mm. Preferably, in this case the ribs 24 have a certain excess size in relation to the surrounding spring 28 of the contact part 26, so that they are deformed slightly when the contact part 26 is introduced into the contact part chamber 12, as shown graphically with reference to FIG. 5 and in particular detail "X".

In order that introduction of the contact part 26 into the contact part chamber 12 is not hindered by this excess size of the ribs 24, in the embodiment shown the ribs 24 have, at the end facing towards the ejection opening 14, in each case a ramp section 34 which widens in the direction of the ejection opening 24 and by which introduction of the contact part 26 into the contact part chamber 12 is made easier.

Furthermore, the ribs 24 seen in cross-section can have a very slender shape which is rectangular or tapers towards their free end, as shown with reference to FIG. 4 and in particular details S1 to S4. As shown by detail S1, for example, the free end of the ribs 24 seen in cross-section can be rounded in semicircular fashion or have a shape tapering to a point, as detail S2 shows. Another possibility would be to give the ribs 24 seen in cross-section a substantially trapezoidal shape, as shown in FIG. 4 with reference to detail S4. All of these shapes of the ribs 24 tapering towards the free end make it possible for the ribs 24 to be easily deformed by the surrounding spring 28 of the contact part 26 when the contact part 26 is introduced into the contact part chamber 12, with the result that the friction between the surrounding spring 28 of the contact part 26 and the ribs 24 is reduced, and so introduction of the contact part 26 into the contact part chamber 12 is made easier.

The invention claimed is:

1. A housing for an electrical connector comprising:

at least one contact part chamber for receiving a contact part, wherein at least one inner surface of the contact part chamber has a draft angle, said chamber further including at least one rib disposed on the inner surface of the draft angle and which has one of, (i) no inclination, and (ii) a lesser inclination than the draft angle, said rib extending in the longitudinal direction of the draft angle;

said rib extends substantially an entire insertion length of said contact part chamber.

2. The housing according to claim 1, wherein the contact part chamber is laterally defined by several draft angles, wherein on the surface of each of the draft angles is provided at least one rib extending in the longitudinal direction.

3. The housing according to claim 1, wherein the contact part chamber widens in the direction of an ejection opening for introducing an injection core into the contact part chamber and taking it out, wherein the height of the ribs which are provided on the draft angles formed in this way increases in the direction of the ejection opening, this being substantially the same amount by which the respective draft angle widens the contact part chamber in a direction of the ejection opening.

4. The housing according to claim 2, wherein both the respective draft angles and the ribs provided on them in each case widen in the direction of the ejection opening with an angle of between 0.25 degrees and 0.75 degree.

5. The housing according to claim 1, wherein the ribs seen in cross-section have a shape which is one of, (i) rectangular, and (ii) tapers towards their free end.

6. The housing according to claim 1, wherein the ribs have a ramp section which widens in the direction of the ejection opening at the end facing towards an ejection opening, whereby the contact part is easily received into the contact part chamber.

7. The housing according to claim 1, wherein the ribs are made in one piece with the contact part chamber.

8. The housing according to claim 1, wherein the housing is formed from a plastic material.

9. The housing according to claim 1, wherein the housing is associated with the contact part arranged in the contact part chamber of the housing.

10. The housing according to claim 9, wherein the ribs have a height such that they are deformed when the contact part is received into the contact part chamber.

11. A housing for an electrical connector comprising:

at least one contact part chamber for receiving a contact part, wherein at least one inner surface of the contact part chamber has a draft angle, said chamber further including at least one rib disposed on the inner surface of the draft angle and which has one of, (i) no inclination, and (ii) a lesser inclination than the draft angle, said rib extending in the longitudinal direction of the draft angle, wherein the housing is associated with the contact part arranged in the contact part chamber of the housing and wherein the contact part has a peripheral surrounding spring, and the inside width between mutually opposed ribs in a slack state is smaller than the outside dimension of the surrounding spring of the contact part located in between.

12. The housing according to claim 1, wherein the at least one rib has a height such that it is deformed when the contact part is received into the contact part chamber.

* * * * *